US005168312A

United States Patent [19]

Aoto et al.

[11] Patent Number: 5,168,312

[45] Date of Patent: Dec. 1, 1992

[54] UNIT FOR DEVELOPING ELECTROSTATIC LATENT IMAGES INCLUDING MEMBER HAVING OVERCOAT LAYER

[75] Inventors: Jun Aoto; Yasuo Hirano, both of Numazu, Japan

[73] Assignee: Ricoh Company, Ltd., Tokyo, Japan

[21] Appl. No.: 596,464

[22] Filed: Oct. 12, 1990

[30] Foreign Application Priority Data

| | | | |
|---|---|---|---|
| Oct. 16, 1989 | [JP] | Japan | 1-266321 |
| Nov. 27, 1989 | [JP] | Japan | 1-304785 |
| Nov. 27, 1989 | [JP] | Japan | 1-304786 |
| Nov. 29, 1989 | [JP] | Japan | 1-307507 |

[51] Int. Cl.[5] ..... G03G 15/08

[52] U.S. Cl. ..... 355/259; 355/245; 355/251; 355/265

[58] Field of Search ..... 355/259, 245, 246, 251, 355/253, 265, 261; 430/120; 118/651, 661; 29/130, 132

[56] References Cited

U.S. PATENT DOCUMENTS

| | | | |
|---|---|---|---|
| 4,445,771 | 5/1984 | Sakamoto et al. | 118/657 X |
| 4,760,422 | 7/1988 | Seimiya et al. | 118/653 X |
| 4,958,197 | 9/1990 | Kinashi et al. | 355/299 |
| 5,017,967 | 5/1991 | Koga | 355/261 |

*Primary Examiner*—A. T. Grimley
*Assistant Examiner*—Thu A. Dang
*Attorney, Agent, or Firm*—Cooper & Dunham

[57] ABSTRACT

A development unit including (i) a latent-electrostatic-image-bearable member, (ii) a development member for supporting a toner thereon and developing latent electrostatic images formed on the latent-electrostatic-image-bearable member into visible toner images with the toner, and (iii) a toner layer regulating member for regulating the thickness of a toner layer formed on the development member, wherein at least the development member or toner layer regulating member has an overcoat layer including a resin and a surface active agent.

25 Claims, 4 Drawing Sheets

UNIT FOR DEVELOPING ELECTROSTATIC LATENT IMAGES INCLUDING MEMBER HAVING OVERCOAT LAYER

BACKGROUND OF THE INVENTION

1. Field of the Invention

The present invention relates to a development unit comprising a latent-electrostatic-image-bearable member, a development member for supporting a toner thereon and developing a latent electrostatic image formed on the above latent-electrostatic-image-bearable member into a visible toner image with a toner, and a toner layer regulating member for regulating the thickness of a toner layer formed on the above development member.

2. Discussion of Background

Conventionally, to develop a latent electrostatic image formed on a latent-electrostatic-image-bearable member into a visible toner image with a non-magnetic one-component type toner, the toner is distributed to a development member and formed into a thin film thereon by a blade- or roller-shaped toner layer regulating member. When the thin film of the toner formed on the surface of the development member is brought into contact with the latent electrostatic image formed on the latent-electrostatic-image-bearable member, such as a photoconductor, the toner is electrostatically attracted to the latent electrostatic image, so that the latent electrostatic image is developed into a visible toner image with the non-magnetic one-component type toner.

In the above development process, the following steps are repeated on the development member:

1. The toner is supplied onto the development member.
2. The toner on the development member is charged to a predetermined polarity.
3. The toner is formed into a thin film on the development member.
4. The toner is transported to the photoconductor by the development member.
5. The toner formed on the development member is attracted to the latent electrostatic image on the photoconductor to achieve the development.
6. The residual electric charge on the development member is removed.

When the development member has finished one cycle of the development process and moves onto the next cycle, a charge with a counter polarity to that of the toner particles is generated in the development member due to the triboelectric effect with the toner particles. In addition, the electric charges may remain on the surface of the development member and inside thereof because it is easily affected by the residual electric potential on the photoconductor. The above-mentioned electric charges cause the deterioration of the chargeability of toner particles and the development characteristics. As a result, the so-called residual image development occurs.

To solve the above-mentioned problem, various methods for quenching the development member are proposed. For example, there is proposed a quenching method of bringing a member with a low resistivity, such as a metallic brush or an electroconductive sponge into contact with the surface of the development member.

However, when the metallic brush is used for quenching the development member, stripes appear on the obtained images because the metallic brush sweeps away the residual electric charge on the surface of the development member, leaving trails. In the case where the electroconductive sponge is used for quenching the development member, satisfactory results cannot also be obtained. In addition, since the above-mentioned metallic brush or electroconductive sponge is brought into contact with the development member through a thin film of the toner formed on the outer surface of the development member, the sufficient quenching effect cannot be desired.

To improve the quenching effect by the metallic brush, the material and the brush density are studied. The effect by the electroconductive sponge is also pursued with a stress laid upon the number of the sponge rollers. In spite of the aforementioned intensive studies, the residual images cannot completely be cleared from the development member.

Many developments are made on the configuration of the development member in order to obtain a development member of which outer surface can be easily initialized, with the residual electric charges not remained thereon.

For example, a development member is proposed, which comprises an electroconductive coating layer which comprises an elastic material with a volume resistivity of $10^5$ to $10^{11}$ Ω.cm, and a semiconductive coating layer which comprises a flexible synthetic resin and electroconductive particles. As the flexible synthetic resin for the semiconductive coating layer of the above development member, acrylonitrile-butadiene rubber, epichlorohydrin rubber, chloroprene rubber or urethane rubber is used, so that it is difficult to make a development member which has a uniform properties. In particular, the resistance of the electrical characteristics of the thus obtained development member to the environmental conditions, such as heat and humidity, is poor. Therefore, the development performance of this development member varies depending on the environmental conditions.

Another development member is proposed. This development member is constructed in such a fashion that a resin or rubber layer with a middle to high volume resistivity and an electrode layer are successively overlaid on an electroconductive elastic substrate with a volume resistivity of $10^6$ Ω.cm or less. The environmental resistance of this development member can be remarkably improved by adding to each layer the resin or rubber with the improved heat and humidity resistance, such as silicone resin, silicone rubber, fluoroplastic and fluororubber.

As previously mentioned, however, since the above development member comprises a resin or rubber layer with a middle to high volume resistivity, the electric charges generated by the triboelectric friction between the development member and toner particles gradually accumulate on the surface of the development member. These residual electric charges have an adverse influence on the chargeability of toner particles and the development characteristics at the succeeding development process, and the so-called residual image development takes place.

Some trials are made to leak the residual electric charge from the above development member. For example, electroconductive particles such as carbon black are dispersed in the aforementioned electrode layer of the development member to decrease the resistivity thereof. However, in the case where the electrode layer of the development member becomes electroconductive to such a degree that the residual electric charge can be leaked therefrom, the following problems occur:

(1) The charge quantity of the toner is decreased, which interrupts the transport performance of the toner to the latent-electrostatic-image-bearable member.

(2) As the resistivity of the electrode layer of the development member decreases, the strength of the electric field between the development member and the latent-electrostatic-image-bearable member increases. This causes an extremely high image density and low resolution of images.

(3) When a large amount of the electroconductive particles are added to the electrode layer of the development member, the releasability of the toner particles from the development member is decreased, which induces the so-called toner-filming phenomenon. This decreases the wear-resistance of the development member.

As the method for controlling the chargeability of the toner particles, studies are made in terms of the above-mentioned blade- or roller-shaped toner layer regulating member.

When the toner particles are distributed to the surface of the development member and formed into a thin film thereon by the toner layer regulating member, the toner particles are charged by the friction with the toner layer regulating member and the development member. When the above-mentioned blade- or roller-shaped toner layer regulating member is made of metal, this metallic toner layer regulating member cannot provide the toner particles with the electric charge in an adequate amount by the triboelectric effect.

To solve the above-mentioned problem, a bias is applied to the metallic toner layer regulating member to impart the desired electric charge to the toner particles. This method is capable of controlling the charge quantity of the toner. However, the releasability of the toner from the metallic toner layer regulating member is not so good that the toner adheres to the surface of the toner layer regulating member. Therefore, the adequate electric charge cannot constantly be imparted to the toner and the thin-film of the toner cannot be uniformly formed around the development member for an extended period of time.

To remove the above-mentioned shortcoming, the particular polymers and fluoroplastics with excellent releasability are proposed to employ for the toner layer regulating member as disclosed in Japanese Laid-Open Patent Application 63-81376. This prevents the adhesion of the toner to the toner layer regulating member, and at the same time, the electric charge can sufficiently be imparted to the toner particles.

However, the above polymers with the excellent releasability have insulation properties. Therefore, when the toner particles are charged to a predetermined polarity by the triboelectric effect, the electric charge with a counter polarity to that of the toner particles is generated in the the tone layer regulating member and it easily remains therein. This residual electric charge in the toner regulating member gives rise to the following problems:

(a) A lot of time is required to attain to the charge quantity saturation point. In other words, the rising performance of the toner is degraded with regard to the electric charging.

(b) The charge quantity saturation point of the toner gradually decreases while the copying operation is continued for an extended period of time.

As can be seen from the above-mentioned problems, the high quality images cannot constantly be obtained for a long time.

To solve the above-mentioned problems, finely-divided particles with a low volume resistivity, such as carbon, are added to the above polymers with the excellent releasability to decrease the volume resistivity of the toner layer regulating member. Thus, the residual electric charge in the toner layer regulating member can be easily leaked therefrom. However, the releasability of the toner from the toner layer regulating member is lowered, so that the toner particles in the melted state are deposited on the surface of the toner layer regulating member.

SUMMARY OF THE INVENTION

Accordingly, an object of the present invention is to provide a development unit with improved durability, capable of constantly producing high quality images, in which development unit, toner particles are satisfactorily charged and the development characteristics do not deteriorate without occurrence of the ghost image development even when a development cycle is repeated for an extended period of time, and a development unit in which toner particles do not adhere to the surface of a development member and a toner layer regulating member.

The above-mentioned object of this invention can be achieved by a development unit which comprises (i) a latent-electrostatic-image-bearable member, (ii) a development member for supporting a toner thereon and developing latent electrostatic images formed o the above latent-electrostatic-image-bearable member into visible toner images with a toner, and (iii) a toner layer regulating member for regulating the thickness of a toner layer formed on the development member, wherein at least the above-mentioned development member or toner layer regulating member comprises an overcoat layer comprising a resin and a surface active agent.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The development unit according to the present invention will now be explained in detail by referring to FIG. 1.

Figure 1:
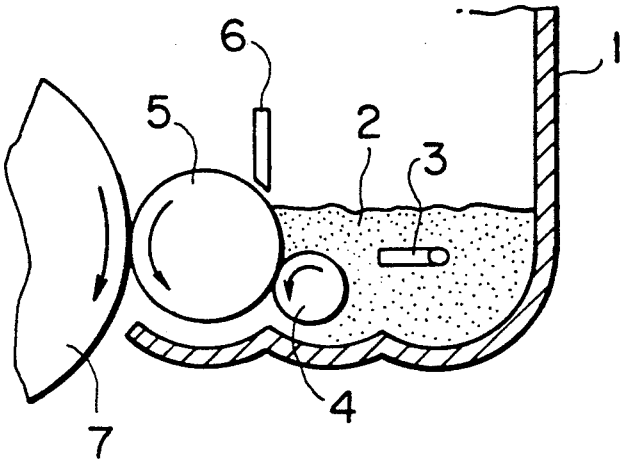
FIGS. 1 to 6 are schematic views of examples of the development unit according to the present invention.

In FIG. 1, a non-magnetic one-component type toner 2 is placed in a development container 1. The above one-component type toner 2 is transported by an agitator 3 to a toner retaining area between a toner replenishment member 4 and a development member 5 and supported on the surface of the development member 5.

The toner 2 is then uniformly formed into a thin film around the development member 5 by a toner layer regulating member 6 (in this figure, a toner-thin-film forming blade). At the same time, the toner 2 is charged to a predetermined polarity by the triboelectric effect. When a portion of the toner thin film reaches the development area where the development member 5 comes into contact with a latent-electrostatic-image-bearable member 7, the toner particles of the above portion are electrostatically attracted to the latent electrostatic images formed on the latent-electrostatic-image-bearable member 7. Thus, the latent electrostatic images are developed to visible toner images with the toner 2.

In the aforementioned process, the toner particles 2 are triboelectrically attracted to the development member 5. After the toner particles 2 have been transported to the latent-electrostatic-image-bearable member 7, the electric charge with a counter polarity to that of the toner particles 2 remains in the development member 5, which causes the so-called residual image development.

In order to quickly leak the above counter charge from the development member 5, to improve the chargeability and releasability of toner particles 2, and to promote the smooth transportation of the toner particles 2 to the latent-electrostatic-image-bearable member 7, the development member 5 of the present invention comprises an overcoat layer which comprises a resin and a surface active agent.

The development member for use in the present invention is usable when a non-magnetic one-component type toner or a magnetic one-component type toner is employed in the development unit. Furthermore, a roller- or belt-shaped development member may be used in the present invention. In addition, the latent-electrostatic-image-bearable member 7 in FIG. 1 is not limited to a photoconductive drum, and any member capable of retaining the latent electrostatic image thereon can be employed.

Figure 7:
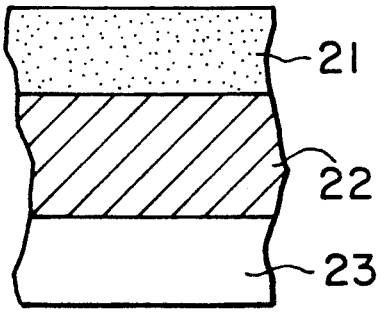
FIGS. 7 and 8 are schematic cross-sectional views of a development member for use in the development unit according to the present invention.

One example of the configurations of the development member 5 as used in FIG. 1 is shown in FIG. 7.

The development member in FIG. 7 is constructed in such a manner that an electroconductive elastic layer 22 and an overcoat layer 21 are successively overlaid on a metallic core 23.

For the material of the core 23, conventional metallic materials, such as stainless, aluminum and iron can be used.

The electroconductive elastic layer 22 is provided in the case where the latent electrostatic images are developed to visible toner images by bringing the development member 5 into contact with the latent-electrostatic-image-bearable member 7 (photoconductive drum). This is because the above contact development required the elasticity of the development member 5. When a belt-shaped photoconductor is used as the latent-electrostatic-image-bearable member 7, the electroconductive elastic layer 22 may not be provided on the metallic core 23.

The electroconductive elastic layer 22 serves as a counter electrode, so that it is desirable that the electroconductive elastic layer 22 comprise an electroconductive elastic material with the volume resistivity of $10^{12}$ Ω.cm or less.

Examples of the above electroconductive elastic materials for the electroconductive elastic layer 22 are polar rubbers such as styrene - butadiene rubber, epichlorohydrin rubber, acrylic rubber and chloroprene rubber; and high-resistivity rubbers such as silicone rubber, EPDM and fluororubber in which rubbers low-resistivity particles such as carbon particles are dispersed. Of these elastic materials, the silicone rubber is preferably used because the hardness thereof can be decreased without addition of any plasticizer thereto.

These electroconductive elastic materials are formed into a layer by the general molding methods, such as press molding, injection molding and extrusion. The thus molded electroconductive elastic layer 22 is further subjected to abrasive finishing to obtain a desired thickness. It is preferable that the thickness of the electroconductive elastic layer 22 be 1 mm or more to obtain a sufficient elastic effect thereof.

Examples of the materials for the overcoat layer 21 of the development member 5 include resins such as alkyd resin, chlorinated polyether, chlorinated polyethylene, epoxy resin, fluoroplastic, phenolic resin, polyamide, polycarbonate, polyethylene, methacrylic resin, polypropylene, polystyrene, polyurethane, polyvinyl chloride, polyvinylidene chloride and silicone resin; and rubbers such as butadiene rubber, styrene-butadiene rubber, ethylene propylene rubber, chloroprene rubber, chlorinated polyethylene, epichlorohydrin rubber, nitrile rubber, acrylic rubber, silicone rubber and fluororubber. Of these, the silicone resin and the fluoroplastic are preferable from the viewpoints of the heat-resistance and moisture-resistance.

The thickness of the overcoat layer 21, which can freely be determined with the electrical properties such as the volume resistivity and dielectric constant taken into consideration, is generally in the range of 50 μm to 2 mm.

The overcoat layer 21 can be prepared by the appropriate method, such as spray coating, dip coating, steam curing or extrusion curing.

In the present invention, the overcoat layer 21 further comprises a surface active agent. As the surface active agent for use in the present invention, nonionic, ionic (cationic and anionic) and ampholytic surface active agents can be used.

Specific examples of the nonionic surface active agent are ester compounds such as fatty acid ether - ester compounds, ether compounds and condensation products of amides.

Specific examples of the cationic surface active agent are salts of aliphatic amine and quaternary ammonium salts thereof, aromatic quaternary ammonium salts and heterocyclic quaternary ammonium salts.

Specific examples of the anionic surface active agent are alkyl carboxylate, salts of N-acyl amino acid, alkyl ether carboxylate, acylated peptide, alkyl sulfonate, alkylbenzenesulfonate, alkylnaphthalenesulfonate, sulfosuccinate, α-olefin sulfonate, N-acyl sulfonate, alkyl sulfate, alkyl ether sulfate, alkyl allyl ether sulfate, alkylamide sulfate, alkyl phosphate, alkyl ether phosphate and alkyl allyl ether phosphate.

Specific examples of the ampholytic surface active agent are carboxybetaine, sulfobetaine, and amino carboxylate.

In the present invention, a fluorine-containing surface active agent is more preferably employed from the viewpoint of the environmental resistance of the development member.

Specific examples of the nonionic fluorine-containing surface active agent are perfluoroalkyl-group-lipophilic-group-containing oligomers, perfluoroalkyl-group-hydrophilic-group-containing oligomers and perfluoroalkylethylene oxide adducts. As the cationic fluorine-containing surface active agent, perfluoroalkyl-containing quaternary ammonium salts can be employed. As the anionic fluorine-containing surface active agent, monovalent metal salts of perfluoroalkyl-containing sulfonic acids and perfluoroalkyl-containing carboxylic acids, and phosphoric esters. As the ampholytic fluorine-containing surface active agent, perfluoroalkyl-containing betaines.

The fluorine-containing surface active agent may appropriately be selected from the above, with the compatibility of the surface active agent with the above-mentioned resin or rubber taken into consideration. The nonionic surface active agent can be used together with the ionic or ampholytic surface active agent.

It is preferable that the amount of the surface active agent in the overcoat layer of the development member for use in the present invention be in the range of 0.1 to 50 parts by weight, and more preferably in the range of 0.5 to 20 parts by weight of 100 parts by weight of the solid content of the above-mentioned resin. When the surface active agent is contained in the overcoat layer 21 at the above mixing ratio, not only the effect of the surface active agent can be remarkably exerted, but also the wear-resistance and the environmental resistance of the development member do not deteriorate and the transport performance of the toner particles can be maintained.

In the present invention, an inorganic filler, crosslinking agent, a heat stabilizer and a processing aid are employed for constructing the development member.

Examples of the inorganic filler for use in the present invention include finely-divided particles of diatomaceous earth, quartz, iron oxide, zinc oxide, titanium oxide, calcium oxide, magnesium oxide, talc, aluminum silicate and aluminum oxide; fibers of potassium titanate, asbestos, glass and carbon; and particles of Teflon and boron nitride.

The toner for use in the present invention, which may be positively or negatively chargeable, can be selected from the conventional toners. For example, the resin particles such as styrene - n-butyl methacrylate or epoxy resin in which a coloring agent is dispersed can be used. The above-mentioned toner may further contain a chargeability controlling agent such as a nigrosine dye and a basic dye; a fluidity promoting agent such as silica; an abrasive such as silicon carbide; and a lubricant such as a metallic salt of a fatty acid.

The above-mentioned first embodiment of the present invention will now be explained in detail by the following examples.

EXAMPLE 1—1

A commercially available electroconductive primer, "DY39-011" (Trademark), made by Toray Silicone Co., Ltd., was applied to a metallic core with a diameter of 6 mm.

Formation of Electroconductive Elastic Layer

The following components were kneaded in a two-roll mill.

| | Parts by Weight |
|---|---|
| Methylvinyl polysiloxane | 100 |
| Carbon, "Ketjen Black EC" (Trademark) made by Lion.Akzo Co., Ltd. | 5 |
| Quartz | 20 |

To 100 parts by weight of the above mixture, 1.5 parts by weight of a commercially available crosslinking agent, 2,4-dimethyl-2,4-di-tert-butyl peroxyhexane, "RC-4" (Trademark), made by Toray Silicone Co., Ltd., was added, and the thus obtained composition was formed into a layer around the metallic core by the press molding method under the following curing conditions:

| | |
|---|---|
| (First curing) | |
| Curing temperature | 170° C. |
| Curing time | 10 minutes |
| Pressure | 120 kg/cm$^2$ |
| (Second curing) | |
| Curing temperature | 200° C. |
| Curing time | 4 hours |

Thus, an electroconductive elastic layer, with a thickness of 6 mm, a volume resistivity of $1.5\times10^5$ Ω.cm and a rubber hardness of 28° in accordance with JIS, was formed on the metallic core.

Formation of Overcoat Layer

After the surface of the above electroconductive elastic layer was cleaned by Trichlene, a 1% xylene solution of a commercially available titanate-type coupling agent "TA-25" (Trademark), made by Matsumoto Seiyaku Kogyo Co., Ltd., was applied to the surface thereof and dried for 30 minutes.

The mixture of the following components was spray-coated on the above electroconductive elastic layer and cured at 150° C. for one hour, so that an overcoat layer was formed on the electroconductive elastic layer. The surface of the overcoat layer was subjected to abrasion to obtain the thickness of 50 μm.

Thus, development member No. 1—1 with the configuration as shown in FIG. 7 was prepared.

| | Parts by Weight |
|---|---|
| Fluorine-containing copolymer resin "Lumifron 601C" (Trademark) made by Asahi Glass Co., Ltd. (solid content: 50%) | 100 |
| 50% xylene solution of "Coronate EH" made by Nippon Polyurethane Co., Ltd. | 20 |
| Methyl ethyl ketone | 400 |
| Fluorine-containing cationic surface active agent $[C_8F_{17}SO_2NH(C_3H_6)N^+(CH_3)_3I^-]$ | 5 |

EXAMPLE 1-2

The procedure for preparation of the development member No. 1—1 in Example 1—1 was repeated except that the fluorine-containing cationic surface active agent contained in the composition for the overcoat layer used in Example 1—1 was replaced by a fluorine-containing anionic surface active agent ($C_7F_{15}COONa$). Thus, development member No. 1-2 was prepared.

EXAMPLE 1-3

The procedure for preparation of the development member No. 1—1 in Example 1—1 was repeated except that the fluorine-containing cationic surface active agent contained in the composition for the overcoat layer used in Example 1—1 was replaced by a fluorine-containing ampholytic surface active agent [$C_8F_{15}SO_2NH(C_3H_6)N^+$ $(CH_3)_2.C_2H_4COO^-$]. Thus, development member No. 1-3 was prepared.

EXAMPLE 1-4

The procedure for preparation of the development member No. 1—1 in Example 1—1 was repeated except that the fluorine-containing cationic surface active agent contained in the composition for the overcoat layer used in Example 1—1 was replaced by a hydrocarbon cationic surface active agent [$C_{12}H_{25}SO_2NH(C_3H_6)N^+$ $(CH_3)_3I^-$]. Thus, development member No. 1-4 was prepared.

EXAMPLE 1-5

The procedure for preparation of the development member No. 1—1 in Example 1—1 was repeated except that the fluorine-containing cationic surface active agent contained in the composition for the overcoat layer used in Example 1—1 was replaced by a hydrocarbon anionic surface active agent ($C_7H_{15}COONa$). Thus, development member No. 1-4 was prepared.

EXAMPLE 1-6

The procedure for preparation of the development member No. 1—1 in Example 1—1 was repeated except that the fluorine-containing cationic surface active agent contained in the composition for the overcoat layer used in Example 1—1 was replaced by a hydrocarbon ampholytic surface active agent ($C_{14}H_{29}CHOO^-$). Thus, development member No. 1-6 was $N(CH_3)$ prepared.

COMPARATIVE EXAMPLE 1—1

The procedure for preparation of the development member No. 1—1 in Example 1—1 was repeated except that the fluorine-containing cationic surface active agent contained in the composition for the overcoat layer used in Example 1—1 was not used. Thus, comparative development member No. 1—1 was prepared.

COMPARATIVE EXAMPLE 1-2

The procedure for preparation of the development member No. 1—1 in Example 1—1 was repeated except that the fluorine-containing cationic surface active agent contained in the composition for the overcoat layer used in Example 1—1 was replaced by 15 parts by weight of the following carbon black masterbatch.

The above-mentioned carbon black masterbatch was prepared by dispersing a mixture of the following components in a ball mill for 72 hours:

| | Parts by Weight |
|---|---|
| Fluorine-containing copolymer resin "Lumifron 601C" (Trademark) made by Asahi Glass Co., Ltd. (solid content: 50%) | 100 |
| Carbon black "Black Pearl L" (Trademark) made by Cabot Corporation | 40 |
| Toluene | 50 |

-continued

| | Parts by Weight |
|---|---|
| Xylene | 50 |

Thus, comparative development member No. 1-2 was prepared.

COMPARATIVE EXAMPLE 1-3

The procedure for preparation of the comparative development member No. 1-2 in Comparative Example 1-2 was repeated except that 50 parts by weight of the same carbon black masterbatch as employed in Comparative Example 1-2 was used. Thus, comparative development member No. 1-3 was prepared.

With regard to the charge quantity of the toner, the releasability of the toner particles from the development member, the wearability of the development member, the appearance of ghost images and the unevenness of the obtained images, the above prepared development members No. 1—1 to No. 1-6 for use in the present invention and comparative development members No. 1—1 to No. 1-3 were evaluated at 10° C. and 24% RH, at 20° C. and 50% RH, and at 30° C. and 80% RH. Each evaluation was made by the following method.

The results of the evaluation are given in Table 1.

(1) Charge Quantity of Toner

Each of the above prepared development members was set in a development unit as shown in FIG. 1. The above development unit was supplied with negatively chargeable toner particles having a particle diameter of 12 μm with the following formulation, and the charge quantity of the toner was measured by the blow-off method.

| | Parts by Weight |
|---|---|
| Styrene acrylic resin | 100 |
| Carbon | 10 |
| Chromium-containing monoazo dye | 2 |

(2) Releasability of Toner from Development Member

The same development unit with the negatively chargeable toner as in the above evaluation (1) was caused to operate for 72 hours without passing paper therethrough. The adhesion of toner particles to the surface of the development member was assessed in accordance with the following ranks:

Rank A: The toner particles were easily removed from the surface of the development member with a cloth.

Rank B: After the surface of the development member was wiped, toner particles slightly remained thereon.

Rank C: After the surface of the development member was wiped, a thin film of the toner remained thereon.

Rank D: The toner particles in the melted state were tightly deposited on the surface of the development member.

(3) Wearability of Development Member

The same development unit with the negatively chargeable toner as in the above evaluation (1) was caused to operate for 20 hours without passing paper therethrough. The degree of wear of the development member was assessed by measuring the diameter thereof by a commercially available laser microgauge, "DT-4002A" (Trademark), made by Iwatsu Electronics Co., Ltd.

(4) Image Quality—Ghost Images

By using the same development unit with the negatively chargeable toner as in the above evaluation (1), a solid toner image was formed on a photoconductive member. After the solid toner image was transferred from the photoconductive member to a transfer sheet. A dot toner image was then formed on the photoconductive member so as to cover the position where the above-mentioned solid toner image was formed. The thus formed dot toner image was transferred to a transfer sheet. After these two development steps, the image density ($ID_L$) of the portion corresponding to the portion where the solid toner image was formed, and the image density ($ID_H$) of the dot toner image portion outside the portion corresponding to the solid toner image were measured by a Mcbeth densitometer in a left side point and a right side point in each transfer sheet sample, and the ratio of the two image densities ($ID_L/ID_H$) was calculated.

(5) Unevenness of Images

Using the same development unit with the negatively chargeable toner as in the above evaluation (1), five copies with a solid image were made by rotating the roller-shaped development member five times. With respect to each sample, the value $ID/OD \times 100$ was measured, where OD is the image density of a solid image area of an original employed, and ID is the image density of the copied solid image area.

In the above-mentioned evaluations, the development unit as shown in FIG. 1 was equipped with a toner layer regulating blade 6 with a thickness of 1 mm, comprising a silicone rubber, a toner replenishment roller 4 made of an electroconductive urethane sponge, and an organic photoconductive member 7.

ment member and the wear-resistance of the development member.

In the second embodiment of the present invention, a development member comprises an electroconductive substrate, a first overcoat layer comprising a resin and a surface active agent and a second overcoat layer comprising a resin. In addition, the above electroconductive substrate of the development member may be grounded.

The second embodiment of the present invention will now be explained in detail by referring to FIG. 2.

Figure 2:
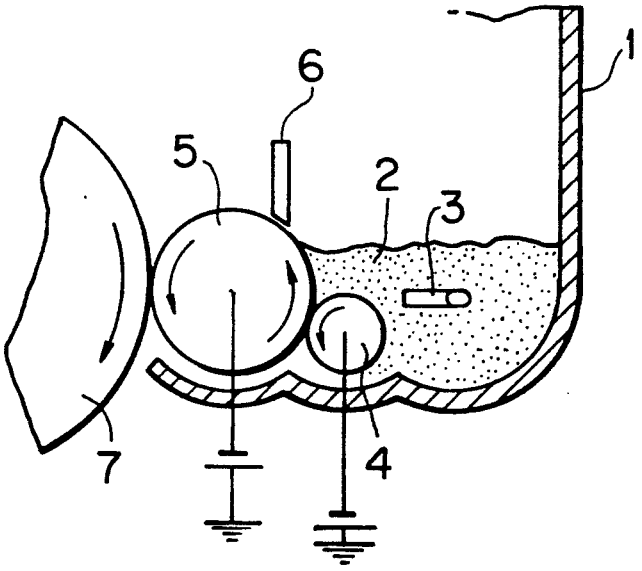

In FIG. 2, the same development process is performed as in FIG. 1.

In the development process, as previously described, toner particles 2 are triboelectrically attracted to a development member 5 which is grounded. In this figure, a toner replenishment roller 4 is also grounded. After the toner particles 2 have been transported to a latent-electrostatic-image-bearable member 7, the electric charge with a polarity opposite to that of the charged toner 2 remains in the development member 5, which may cause the so-called ghost image development.

In the present invention, by incorporating the surface active agent into the resin overcoat layer of the development member 5, the formation of residual toner images on the transfer paper can be prevented. This is because the charge mobility between the overcoat layer and the electroconductive substrate is so significantly improved that the electric charge having a polarity opposite to that of the charged toner 2, which are triboelectrically generated on the surface of the resin overcoat layer by the friction between the toner particles 2 and the resin of the overcoat layer, are smoothly injected into the overcoat layer from the electroconductive substrate when grounded. As a result, the triboelectric charging capability of the resin overcoat layer can be easily recovered and initialized for the succeeding development.

In this second embodiment, a second overcoat layer comprising a resin is overlaid on the first overcoat layer comprising the resin and the surface active agent. By

TABLE 1

| | 10° C., 24% RH | | | | | | 20° C., 50% RH | | | | | | 30° C., 80% RH | | | | | |
|---|---|---|---|---|---|---|---|---|---|---|---|---|---|---|---|---|---|---|
| Exa. | Charge Quantity of Toner (μC/g) | Releasability from Roller | Wearability of Roller (μm) | Appearance of Ghost Images [4] | | Unevenness of Images (%) | | | | [4] | | | | | | [4] | | |
| No. | [1] | [2] | [3] | Right | Left | [5] | [1] | 2 | [3] | R | L | [5] | [1] | 2 | [3] | R | L | [5] |
| 1-1 | −13 | A | 1.0 | 1.0 | 1.0 | 100 | −12 | A | 1.0 | 1.0 | 1.0 | 100 | −11 | A | 1.0 | 1.0 | 1.0 | 100 |
| 1-2 | −13 | A | 1.0 | 1.0 | 1.0 | 100 | −11 | A | 1.0 | 1.0 | 1.0 | 100 | −10 | A | 1.0 | 1.0 | 1.0 | 100 |
| 1-3 | −12 | A | 1.0 | 1.0 | 1.0 | 100 | −11 | A | 1.0 | 1.0 | 1.0 | 100 | −10 | A | 1.0 | 1.0 | 1.0 | 100 |
| 1-4 | −15 | A | 1.0 | 0.9 | 0.9 | 97 | −12 | A | 1.0 | 1.0 | 1.0 | 100 | −6 | A | 1.0 | 1.0 | 1.0 | 90 |
| 1-5 | −17 | A | 1.0 | 0.8 | 0.8 | 96 | −13 | A | 1.0 | 1.0 | 1.0 | 100 | −7 | A | 1.0 | 1.0 | 1.0 | 89 |
| 1-6 | −14 | A | 1.0 | 0.8 | 0.8 | 98 | −11 | A | 1.0 | 1.0 | 1.0 | 100 | −5 | A | 1.0 | 1.0 | 1.0 | 93 |
| Comp 1-1 | −16 | A | 1.0 | 0.6 | 0.6 | 95 | −16 | A | 1.0 | 0.6 | 0.6 | 95 | −15 | A | 1.0 | 0.6 | 0.6 | 92 |
| Comp 1-2 | −11 | A | 4.0 | 0.7 | 0.7 | 95 | −10 | A | 5.0 | 0.7 | 0.7 | 95 | −10 | A | 6.0 | 0.7 | 0.7 | 93 |
| Comp 1-3 | −7 | D | 7.0 | 0.9 | 0.9 | 82 | −5 | D | 8.0 | 1.0 | 1.0 | 80 | −3 | D | 9.0 | 1.0 | 1.0 | 77 |

As previously mentioned, since the development member for use in the present invention comprises an overcoat layer which comprises a resin and a surface active agent, the ghost image development can be prevented, and at the same time, satisfactory results can be obtained with regard to the charge quantity of toner, the releasability of toner particles from the develop-providing the second overcoat layer, the thickness of the first overcoat layer can be reduced. As a result, the amount of the surface active agent can be decreased, which makes it possible to reduce the manufacturing cost. In addition, the decrease in the amount of the surface active agent can prevent the deterioration of mechanical strength of the first overcoat layer, which leads to the increase in the mechanical strength of the the development member.

The development member 5 of FIG. 2 for use in the present invention is applicable to not only a non-magnetic one-component type toner, but also a magnetic one-component type toner. Furthermore, a roller- or belt-shaped development member 5 may be used in the present invention. In addition, the latent-electrostatic-image-bearable member 7 in FIG. 2 is not limited to the photoconductive drum, and any member capable of retaining the latent electrostatic image thereon can be employed.

Figure 8:
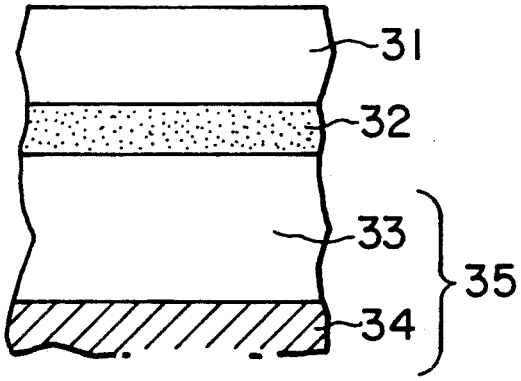

One example of the configuration of the development member 5 of FIG. 2 is shown in FIG. 8.

The development member of FIG. 8 is constructed in such a manner that a first overcoat layer 32 comprising a resin and a surface active agent and a second overcoat layer 31 comprising a resin are successively overlaid on an electroconductive substrate 35. In this figure, the electroconductive substrate consists of a metallic core 34 and an electroconductive elastic layer 33.

In this development member 5 as shown in FIG. 8, the materials for the metallic core 34 and the electroconductive elastic layer 33 are the same as previously mentioned in FIG. 7.

It is preferable that the thickness of the first overcoat layer 32 in the development member of FIG. 8 be in the range of 1 μm to 2 mm. The same resins and surface active agents as in the overcoat layer of the development member as shown in FIG. 7 can be employed in the first overcoat layer 32.

The same resins as used in the first overcoat layer 32 can be employed in the second overcoat layer 31. The second overcoat layer 31 may further comprise a filler such as a chargeability controlling agent to improve the triboelectric performance with the toner particles.

The resins and the surface active agents for use in the first and second overcoat layers 32 and 31 may appropriately be determined with the compatibility thereof taken into consideration. In particular, when the fluoroplastic or silicone resin is used in combination with the fluorine-containing surface active agent, the environmental resistance of the development member and releasability of toner particles therefrom can be improved.

The ionic surface active agent can be used with the nonionic surface active agent in the development member of FIG. 8. It is preferable that the amount of the surface active agent in the first overcoat layer of the development member in FIG. 8 be in the range of 0.1 to 50 parts by weight, and more preferably in the range of 0.5 to 20 parts by weight of 100 parts by weight of the solid content of the binder resin.

For various purposes, in the development member of FIG. 8, the same inorganic filler, crosslinking agent, heat stabilizer and processing aid as used in that of FIG. 7 may also be added to the first and second overcoat layers 32 and 31.

The above-mentioned second embodiment of the present invention will now be explained in detail by the following examples.

EXAMPLE 2-1

A commercially available electroconductive primer, "DY39-011" (Trademark), made by Toray Silicone Co., Ltd., was applied to a metallic core with a diameter of 6 mm.

Formation of Electroconductive Elastic Layer

The following components were kneaded in a two-roll mill.

| | Parts by Weight |
|---|---|
| Methylvinyl polysiloxane | 100 |
| Carbon, "Ketjen Black EC" (Trademark) made by Lion.Akzo Co., Ltd. | 5 |
| Quartz | 20 |

To 100 parts by weight of the above mixture 1.5 parts by weight of a commercially available crosslinking agent, 2,4-dimethyl-2,4-di-tert-butyl peroxyhexane, "RC-4" (Trademark), made by Toray Silicone Co., Ltd., was added, and the thus obtained composition was formed into a layer by the press molding method under the following curing conditions:

| | |
|---|---|
| (First curing) | |
| Curing temperature | 170° C. |
| Curing time | 10 minutes |
| Pressure | 120 kg/cm$^2$ |
| (Second curing) | |
| Curing temperature | 200° C. |
| Curing time | 4 hours |

Thus, an electroconductive elastic layer, with a thickness of 6 mm, a volume resistivity of $1.5\times10^5$ Ω.cm and a hardness of 28° in accordance with JIS, was formed on the metallic core.

Formation of First Overcoat Layer

After the surface of the above electroconductive elastic layer was cleaned by Trichlene, a 1% xylene solution of a commercially available titanate-type coupling agent "TA-25" (Trademark), made by Matsumoto Seiyaku Kogyo Co., Ltd., was applied to the surface thereof and dried for 30 minutes.

The mixture of the following components was spray-coated on the above electroconductive elastic layer and cured at 100° C. for one hour, so that a first overcoat layer was formed on the electroconductive elastic layer. The surface of the first overcoat layer was subjected to abrasion to obtain the thickness of 10 μm.

| | Parts by Weight |
|---|---|
| Fluorine-containing copolymer resin "Lumifron 601C" (Trademark) made by Asahi Glass Co., Ltd. (solid content: 50%) | 100 |
| 50% xylene solution of "Coronate EH" made by Nippon Polyurethane Co., Ltd. | 20 |
| Methyl ethyl ketone | 400 |
| Fluorine-containing cationic surface active agent "EF 132" (Trademark) made by Mitsubishi Metal Corporation | 5 |

Formation of Second Overcoat Layer

The mixture of the following components was spray-coated on the above prepared first overcoat layer and dried at 100° C. for one hour, so that a second overcoat layer was formed on the first overcoat layer. The second overcoat layer was then subjected to abrasion until the thickness thereof reached 40 μm.

| | Parts by Weight |
|---|---|
| Fluorine-containing copolymer resin "Lumifron 601C" (Trademark) made by Asahi Glass Co., Ltd. (solid content: 50%) | 100 |
| 50% xylene solution of "Coronate EH" made by Nippon Polyurethane Co., Ltd. | 20 |
| Methyl ethyl ketone | 400 |

Thus, development member No. 2-1 with the configuration as shown in FIG. 8 was prepared.

EXAMPLE 2—2

The procedure for preparation of the development member No. 2-1 in Example 2-1 was repeated except that the cationic surface active agent contained in the composition for the first overcoat layer used in Example 2-1 was replaced by a commercially available anionic surface active agent "EF 102" (Trademark), made by Mitsubishi Metal Corporation. Thus, development member No. 2—2 was prepared.

EXAMPLE 2-3

The procedure for preparation of the development member No. 2-1 in Example 2-1 was repeated except that the cationic surface active agent contained in the composition for the first overcoat layer used in Example 2-1 was replaced by a commercially available ampholytic surface active agent "Ftergent 400S" (Trademark), made by Neos Co., Ltd. Thus, development member No. 2-3 was prepared.

COMPARATIVE EXAMPLE 2-1

The procedure for preparation of the development roller No. 2-1 in Example 2-1 was repeated except that the first overcoat layer was not provided. Thus, comparative development member No. 2-1 was prepared.

COMPARATIVE EXAMPLE 2—2

The procedure for preparation of the development member No. 2-1 in Example 2-1 was repeated except that the second overcoat layer was not provided. Thus, comparative development member No. 2—2 was prepared.

COMPARATIVE EXAMPLE 2-3

The procedure for preparation of the development member No. 2—2 in Example 2—2 was repeated except that the second overcoat layer was not provided. Thus, comparative development member No. 2-3 was prepared.

COMPARATIVE EXAMPLE 2-4

The procedure for preparation of the development member No. 2-3 in Example 2-3 was repeated except that the second overcoat layer was not provided. Thus, comparative development member No. 2-4 was prepared.

The above prepared development members No. 2-1 to No. 2-3 for use in the present invention and comparative development members No. 2-1 to No. 2-4 were evaluated with regard to the charge quantity of the toner and the appearance of ghost toner images. Each evaluation was made by the same method as previously mentioned, except that a development unit as shown in FIG. 2 was used.

The results of the evaluation are given in Table 2.

TABLE 2

| | Charge Quantity of Toner (μC/g) | Appearance of Ghost Toner Images | |
|---|---|---|---|
| | | Right side | Left side |
| Example 2-1 | −11 | 1.0 | 1.0 |
| Example 2-2 | −13 | 1.0 | 1.0 |
| Example 2-3 | −12 | 1.0 | 1.0 |
| Comparative Example 2-1 | −12 | 0.8 | 0.8 |
| Comparative Example 2-2 | −6 | 1.0 | 1.0 |
| Comparative Example 2-3 | −7 | 1.0 | 1.0 |
| Comparative Example 2-4 | −5 | 1.0 | 1.0 |

As previously mentioned, since the development member for use in the present invention comprises a first overcoat layer which comprises a resin and a surface active agent and a second overcoat layer which comprises a resin, and the development member is grounded via the electroconductive substrate thereof, the formation of residual toner images on the transfer paper can be prevented, and at the same time, the toner is always provided with an adequate charge quantity regardless of the kind of the surface active agent contained in the first overcoat layer. In addition, the amount of the expensive surface active agent can be decreased, which leads to the reduction of the manufacturing cost. Furthermore, the mechanical strength of the development unit according to the present invention can be improved.

In the third embodiment of the development unit according to the present invention, a toner layer regulating member comprises an overcoat layer which comprises a resin and a surface active agent. In addition, the development unit of the third embodiment further comprises a means for injecting electric charges into a toner through the toner layer regulating member.

The third embodiment of the development unit according to the present invention will now be explained in detail by referring to FIG. 3.

Figure 3:
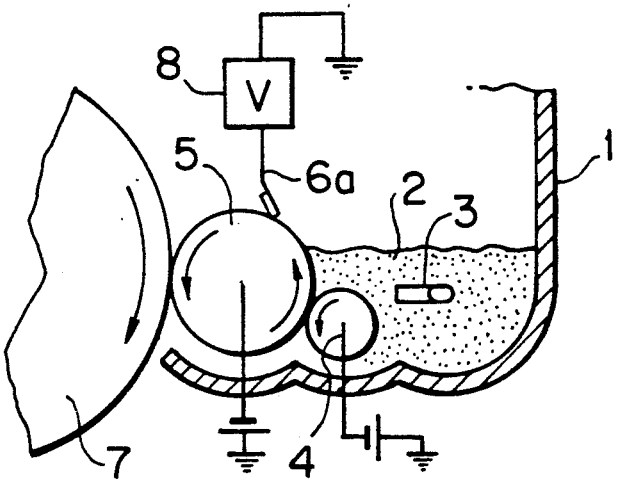

In FIG. 3, a non-magnetic one-component type toner 2 is placed in a development container 1. The above one-component type toner 2 is transported by an agitator 3 to a toner retaining area between a toner replenishment roller 4 and a development member 5, and supported on the surface of the development member 5.

The toner 2 is then uniformly formed into a thin film around the development member 5 by a toner layer regulating member 6a, and more specifically, a toner-thin-film forming blade in this figure. The toner 2 is charged to a predetermined polarity when electric charges are injected into the toner 2 by a charge injection means 8. When a portion of the toner thin film reaches the development area where the development member 5 comes into contact with a latent-electrostatic-image-bearable member 7, the toner particles of the above portion are electrostatically attracted to the latent electrostatic images formed on the latent-electrostatic-image-bearable member 7. Thus, the latent electrostatic images are developed to visible toner images with the toner 2.

Figure 4:
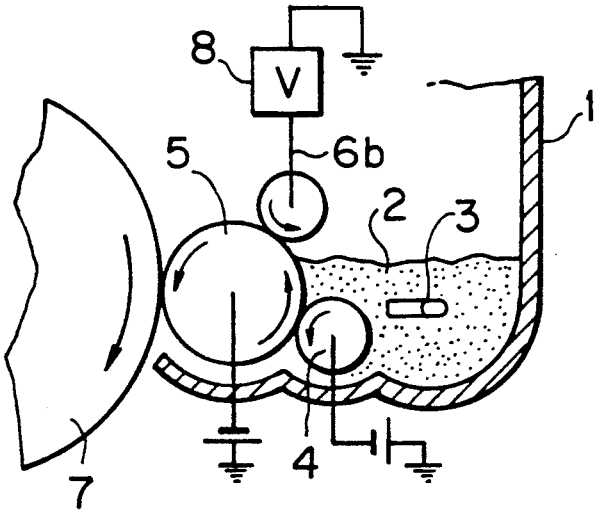

In FIG. 3, a blade-shaped toner layer regulating member 6a is used. Instead of the blade-shaped one, a roller-shaped toner layer regulating member 6b can be employed as shown in FIG. 4. This roller-shaped toner layer regulating member is rotated in the direction opposite to that of the development member 5 at the contact portion thereof.

While the toner 2 is formed into a thin film around the development member 5 and charged to a predetermined polarity by use of the blade- or roller-shaped toner layer regulating member 6a or 6b, a considerable contact pressure is applied to the toner 2.

During the repeated operation of the development unit, therefore, the toner particles 2 in the melted state are deposited on the surface of the toner layer regulating member 6a or 6b, which causes the uneven toner thin film around the development member 5 and decreases the charge quantity of the toner 2.

In order to prevent the toner particles 2 from adhering to the toner layer regulating member 6a or 6b and to obtain an adequate charge quantity of the toner 2 for an extended period of time, the toner layer regulating member 6a or 6b comprises an overcoat layer which comprises a resin and a surface active agent.

In this embodiment, furthermore, the electric charges are injected into the toner layer which is formed around the development member 5 by the charge injection means 8 through the toner layer regulating member 6a. Accordingly, the charge quantity of toner can externally be controlled. As a result, any materials with the improved environmental resistance and wear resistance can be used for the toner layer regulating member 6a, and at the same time, any kind of the toner 2, which is positively chargeable or negatively chargeable, can be used.

Figure 9:
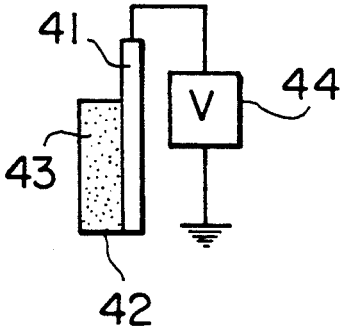
FIGS. 9 to 14 are schematic views of a toner layer regulating member for use in the development unit according to the present invention.
Figure 10:
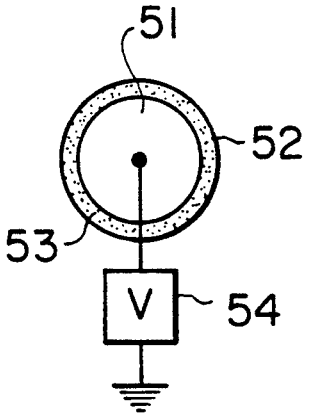

The configuration of the toner layer regulating member 6a of FIG. 3 and that of the toner layer regulating member 6b of FIG. 4 are shown in FIG. 9 and FIG. 10, respectively.

The toner layer regulating member in FIG. 9 is a blade-shaped one, and the toner layer regulating member in FIG. 10 is a roller-shaped one. Both are constructed in such a manner that an overcoat layer 42 (or 52) is overlaid on an electroconductive substrate 41 (or 51).

A charge injection means 44 (or 54) is connected to the electroconductive substrate 41 (or 51), so that a charge is injected into a toner-thin-film formed around the development member through the overcoat layer 42 (or 52) of the toner layer regulating member.

Since the toner layer regulating member 6a (or 6b) comprises the overcoat layer 42 (or 52) which comprises a resin and a surface active agent 43 (or 53) in this embodiment, the electric charges injected into the electroconductive substrate 41 (or 51) by the charge injection means 44 (or 54) can smoothly and rapidly flow to the toner layer around the development member through the overcoat layer 42 (or 52) of the toner layer regulating member 6a (or 6b).

For the electroconductive substrate 41 (or 51), a metal, and an electroconductive resin and rubber can be used.

Examples of the above metal for the electroconductive substrate 41 (or 51) are stainless, iron, copper and aluminum.

The above-mentioned electroconductive resin and rubber for the electroconductive substrate 41 (or 51) can be prepared by adding finely-divided particles of carbon black or metal powder to the resin or rubber.

Specific examples of the resin and rubber for use in the electroconductive substrate 41 (or 51) are alkyd resin, chlorinated polyether, chlorinated polyethylene, epoxy resin, fluoroplastic, phenolic resin, polyamide, polycarbonate, polyethylene, methacrylic resin, polypropylene, polystyrene resin, polyurethane, polyvinyl chloride, polyvinylidene chloride and silicone resin; and butadiene rubber, styrene-butadiene rubber, ethylene propylene rubber, chlorinated polyethylene, epichlorohydrin rubber, nitrile rubber, acrylic rubber, urethane rubber, silicone rubber and fluororubber. Of these, the silicone resin, the fluoroplastic, the silicone rubber and the fluororubber are preferable from the viewpoints of the heat-resistance and humidity-resistance.

The overcoat layer 42 (or 52) which is formed on the above-mentioned electroconductive substrate 41 (or 51) comprises the same resins or rubbers as employed in the above electroconductive substrate 41 (or 51). The overcoat layer 42 (or 52) further comprises a surface active agent.

The same nonionic, cationic, anionic and ampholytic surface active agents contained in the overcoat layer of the development members of FIGS. 7 and 8 can also be used in the toner layer regulating members of FIGS. 9 and 10.

In the toner layer regulating member, a fluorine-containing surface active agent is preferably employed in terms of the environmental resistance. The fluorine-containing surface active agents for use in the overcoat layer of the toner layer regulating member are the same as used in the above-mentioned development member.

The resin and the surface active agent which are compatible with each other may be selected for the overcoat layer of the toner layer regulating member. In particular, the fluoroplastic or silicone resin is preferable for the resin component, and the fluorine-containing surface active agent is preferable for the surface active agent. More preferably, the fluoroplastic or silicone resin is used together with the fluorine-containing surface active agent in the toner layer regulating member. In addition, the ionic surface active agent and the nonionic one can be used together.

The overcoat layer 42 (or 52) can be prepared by the appropriate method, such as spray coating, dip coating, steam curing or extrusion curing.

It is preferable that the amount of the surface active agent in the overcoat layer of the toner layer regulating member be in the range of 0.1 to 50 parts by weight, and more preferably in the range of 0.5 to 20 parts by weight of 100 parts by weight of the solid content of the resin or rubber. When the surface active agent is contained in the overcoat layer 42 (or 52) of the toner layer regulating member at the above mixing ratio, not only the effect of the surface active agent can be remarkably exerted, but also the wear-resistance and the mechanical strength of the toner layer regulating member do not deteriorate.

In this case, the conventional toners can be used. For example, finely-divided particles of a binder resin such as styrene - n-butyl methacrylate or epoxy resin in which a coloring agent is dispersed can be used. The above-mentioned toner particle may further contain a chargeability controlling agent such as a nigrosine dye and a basic dye; a fluidity promoting agent such as silica; an abrasive such as silicon carbide; and a lubricant such as a metallic salt of a fatty acid.

The above-mentioned third embodiment of the present invention will now be explained in detail by the following examples.

EXAMPLE 3-1

A mixture of the following components was dip-coated on a copper plate and dried at 100° C. for one hour, so that an overcoat layer with a thickness of 5 μm was formed.

| | Parts by Weight |
|---|---|
| Fluorine-containing copolymer resin "Lumifron 601C" (Trademark) made by Asahi Glass Co., Ltd. (solid content: 30%) | 100 |
| 50% xylene solution of "Coronate EH" made by Nippon Polyurethane Co., Ltd. | 20 |
| Fluorine-containing cationic surface active agent "EF 132" (Trademark) made by Mitsubishi Metal Corporation | 5 |
| Methyl ethyl ketone | 400 |

Thus, toner layer regulating member No. 1—1 with the configuration as shown in FIG. 9 was prepared.

EXAMPLE 3-2

The procedure for preparation of the toner layer regulating member No. 1—1 in Example 3-1 was repeated except that the cationic surface active agent contained in the composition for the overcoat layer used in Example 3-1 was replaced by a commercially available anionic surface active agent "EF 102" (Trademark), made by Mitsubishi Metal Corporation. Thus, toner layer regulating member No. 1-2 was prepared.

EXAMPLE 3—3

The procedure for preparation of the toner layer regulating member No. 1—1 in Example 3-1 was repeated except that the cationic surface active agent contained in the composition for the overcoat layer used in Example 3-1 was replaced by a commercially available ampholytic surface active agent "Ftergent 400S" (Trademark), made by Neos Co., Ltd. Thus, toner layer regulating member No. 1-3 was prepared.

COMPARATIVE EXAMPLE 3-1

The procedure for preparation of the toner layer reglating member No. 1—1 in Example 3-1 was repeated except that the cationic surface active agent in the composition for the overcoat layer in Example 3-1 was not used. Thus, comparative toner layer regulating member No. 1—1 was prepared.

COMPARATIVE EXAMPLE 3-2

The procedure for preparation of the toner layer regulating member No. 1—1 in Example 3-1 was repeated except that the overcoat layer was not provided. Thus, comparative toner layer regulating member No. 1-2 was prepared.

EXAMPLE 3-4

The procedure for preparation of the toner layer regulating member No. 1—1 in Example 3-1 was repeated except that the composition for the overcoat layer was changed as follows:

| | Parts by Weight |
|---|---|
| Phenolic resin "Plyophen TD 615" (Trademark) made by Dainippon Ink & Chemicals, Inc. (solid content: 57%) | 100 |
| Fluorine-containing cationic surface active agent "EF 132" (Trademark) made by Mitsubishi Metal Corporation | 10 |
| Methyl ethyl ketone | 1000 |

Thus, toner layer regulating member No. 1-4 was prepared.

EXAMPLE 3-5

The procedure for preparation of the toner layer regulating member No. 1-4 in Example 3-4 was repeated except that the cationic surface active agent contained in the composition for the overcoat layer used in Example 3-4 was replaced by a commercially available anionic surface active agent "EF 102" (Trademark), made by Mitsubishi Metal Corporation. Thus, toner layer regulating member No. 1-5 was prepared.

EXAMPLE 3-6

The procedure for preparation of the toner layer regulating member No. 1-4 in Example 3-4 was repeated except that the cationic surface active agent contained in the composition for the overcoat layer used in Example 3-4 was replaced by a commercially available ampholytic surface active agent Ftergent 400S" (Trademark), made by Neos Co., Ltd. Thus, toner layer regulating member No. 1-6 was prepared.

COMPARATIVE EXAMPLE 3—3

The procedure for preparation of the toner layer regulating member No. 1-4 in Example 3-4 was repeated except that the cationic surface active agent in the composition for the overcoat layer in Example 3-4 was not used. Thus, comparative toner layer regulating member No. 1-3 was prepared.

Each of the above prepared toner regulating members No. 1—1 to No. 1-6 for use in the present invention and comparative development rollers No. 1—1 to No. 1-3 was set in the development unit as shown in FIG. 3 and the following evaluation was made. In the evaluation, a development member 5 prepared by coating a resin with an electroconductive silicone rubber; a toner replenishment roller 4 made of an electroconductive urethane rubber; and an organic photoconductor 7 were employed in the development unit.

(1) Charge Quantity of Toner

By providing a development unit as shown in FIG. 3 with positively or negatively chargeable toner with the respective formulations, and electric charges were injected into each toner layer regulating member as shown in Table 3, the initial charge quantity of the toner was measured by the blow-off method. Then, after 10,000 sheets were subjected to the copying operation, the charge quantity of the toner was measured by the blow-off method. The results are shown in Table 4.

| | Parts by Weight |
|---|---|
| (Formation of positively chargeable toner) | |
| Styrene acrylic acid copolymer | 100 |

-continued

| | Parts by Weight |
|---|---|
| Low-molecular weight polypropylene | 5 |
| Nigrosine dye | 2 |
| Carbon | 10 |
| (Formation of negatively chargeable toner) | |
| Styrene acrylic resin | 100 |
| Carbon | 10 |
| Chromium-containing monoazo dye | 2 |

TABLE 3

| | [Intensity of Applied Bias] | |
|---|---|---|
| | Examples 3-1 to 3-3, & Comparative Examples 3-1 and 3-2 | Examples 3-4 to 3-6 & Comparative Example 3-3 |
| Positively chargeable toner is used. | +100 V | +200 V |
| Negatively chargeable toner is used. | −200 V | −100 V |

(2) Adhesion of Toner to Toner Layer Regulating Member

In the development unit as in FIG. 3, the copy-making of 10,000 sheets were carried out. After the above copying operation, the toner layer regulating member was taken out from the development unit. The adhesion of toner particles to the surface of the toner layer regulating member was assessed in accordance with the following ranks:

Rank A: The toner particles were easily removed from the surface of the toner layer regulating member with a cloth.

Rank B: After the surface of the toner layer regulating member was wiped, toner particles slightly remained thereon.

Rank C: After the surface of the toner layer regulating member was wiped, a thin film of the toner remained thereon.

Rank D: The toner particles in the melted state were tightly deposited on the surface of the toner layer regulating member.

(3) Rising Performance of Charge Quantity of Toner

The same negatively or positively chargeable toner as in the evaluation (1) was placed in a development unit as shown in FIG. 3. After the development member made one rotation, the charge quantity of toner ($Q_1$) was measured by the blow-off method. Then, after the development member made five rotations, the charge quantity of toner ($Q_5$) was similarly measured.

The results of the above evaluation are given in Table 4.

TABLE 4

| | | Charge Quantity of Toner (μC/g) | | Adhesion of Toner to Toner Layer Regulating Member | Rising Performance of Charge Quantity of Toner (μC/g) | |
|---|---|---|---|---|---|---|
| | | A** | B** | (Rank) | Q1 | Q2 |
| Ex. 3-1 | (1)* | +12 | +11 | A | +11 | +12 |
| | (2)* | −11 | −11 | A | −10 | −11 |
| Ex. 3-2 | (1) | +13 | +12 | A | +12 | +13 |
| | (2) | −12 | −11 | A | −11 | −12 |
| Ex. 3-3 | (1) | +11 | +10 | A | +10 | +11 |
| | (2) | −12 | −11 | A | −11 | −12 |
| Comp. Ex. 3-1 | (1) | +16 | +6 | A | +7 | +16 |
| | (2) | −12 | −5 | A | −6 | −12 |
| Comp. Ex. 3-2 | (1) | +7 | +4 | D | +6 | +7 |
| | (2) | −11 | −6 | D | −10 | −11 |
| Ex. 3-4 | (1) | +12 | +12 | A | +11 | +12 |
| | (2) | −11 | −11 | A | −10 | −11 |
| Ex. 3-5 | (1) | +13 | +12 | A | +12 | +13 |
| | (2) | −12 | −11 | A | −11 | −12 |
| Ex. 3-6 | (1) | +11 | +11 | A | +10 | +11 |
| | (2) | −12 | −11 | A | −11 | −12 |
| Comp. Ex. 3-3 | (1) | +12 | +4 | A | +7 | +12 |
| | (2) | −15 | −6 | A | −10 | −15 |

*(1): A positively chargeable toner was employed.
(2): A negatively chargeable toner was employed.
**(A): The charge quantity of toner in the initial stage.
(B): The charge quantity of toner after 10,000 sheets were subjected to the copying operation.

Since the toner layer regulating member in the third embodiment comprises an overcoat layer which comprises a resin and a surface active agent, the toner particles do not adhere to the surface of the toner layer regulating member after the repeated operation of the development unit. In addition, the charge quantity of the toner can be controlled regardless of the material for the resin contained in the overcoat layer of the toner regulating member because a charge injection means is provided.

Figure 5:
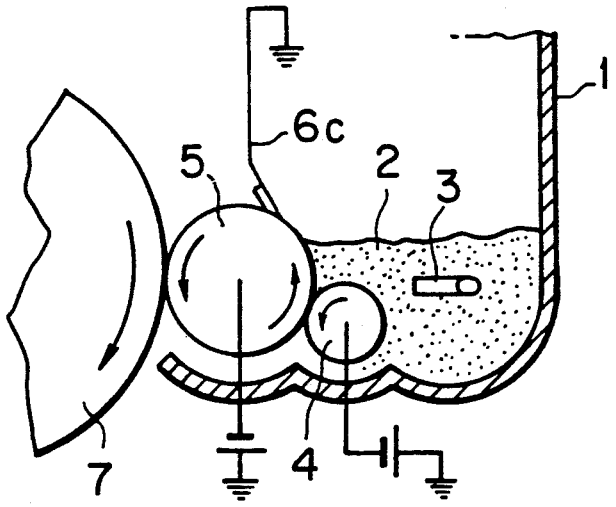
Figure 6:
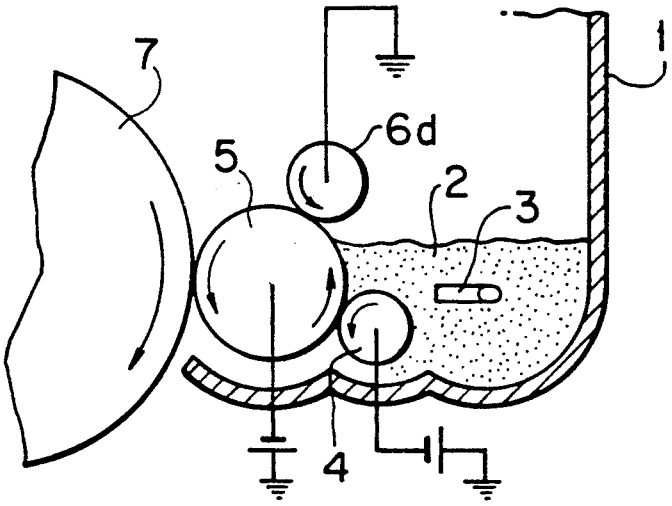

In the development units according to the present invention as shown in FIGS. 5 and 6, a toner layer regulating member 6 is grounded, and a charge injection means is not provided.

Figure 11:
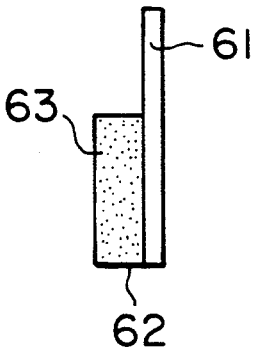

The blade-shaped toner regulating member of FIG. 5 comprises an electroconductive substrate 61 and an overcoat layer 62, formed thereon, which comprises a resin and a surface active agent 63, as shown in FIG. 11. Alternatively, the blade-shaped toner layer regulating member of FIG. 5 may be constructed in such a manner that a first overcoat layer 82 comprising a resin and a surface active agent 83 and a second overcoat layer 84 comprising a resin are successively overlaid on an electroconductive substrate 81, as shown in FIG. 13.

Figure 12:
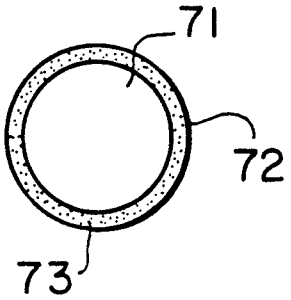

The roller-shaped toner regulating member of FIG. 6 comprises an electroconductive substrate 71 and an overcoat layer 72, formed thereon, which comprises a resin and a surface active agent 73, as shown in FIG. 12. Alternatively, the roller-shaped toner layer regulating member of FIG. 6 may be constructed in such a manner that a first overcoat layer 92 comprising a resin and a surface active agent 93 and a second overcoat layer 94 comprising a resin are successively overlaid on an electroconductive substrate 91, as shown in FIG. 14.

Figure 13:
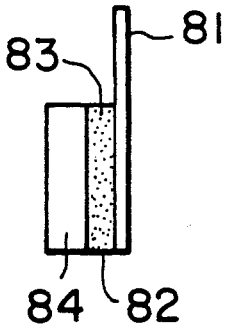
Figure 14:
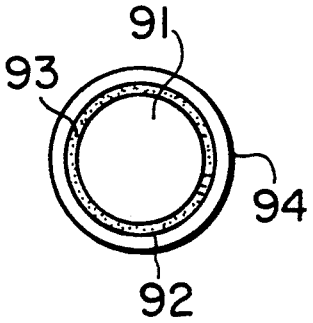

As the resin for the second overcoat layer 84 (or 94) of the toner layer regulating member as shown in FIGS. 13 and 14, the same resins as employed in the first overcoat layer 82 (or 92) can be used. The second overcoat layer 84 (or 94) may further comprise a filler such as a chargeability controlling agent to improve the chargeability of the toner.

By incorporating the surface active agent into the overcoat layer of the toner layer regulating member, the charge mobility between the overcoat layer and the electroconductive substrate is so significantly improved so that the electric charge having a polarity opposite to that of the charged toner, which is triboelectrically generated on the surface of the overcoat layer by the friction between the toner particles and the resin of the overcoat layer, are smoothly injected into the overcoat layer from the electroconductive substrate when grounded. As a result, the triboelectric charging capability of the resin overcoat layer can be easily recovered and initialized for the succeeding development.

The above-mentioned development unit according to the present invention will now be explained in detail by referring to the following examples.

EXAMPLE 4-1

A mixture of the following components was dip-coated on a copper plate and dried at 100° C. for one hour, so that an overcoat layer with a thickness of 20 μm was formed.

| | Parts by Weight |
|---|---|
| Fluorine-containing copolymer resin "Lumifron 601C" (Trademark) made by Asahi Glass Co., Ltd. (solid content: 50%) | 100 |
| 50% xylene solution of "Coronate EH" made by Nippon Polyurethane Co., Ltd. | 20 |
| Fluorine-containing cationic surface active agent "EF 132" (Trademark) made by Mitsubishi Metal Corporation | 5 |
| Methyl ethyl ketone | 400 |

Thus, toner layer regulating member No. 2-1 with the configuration as shown in FIG. 11 was prepared.

EXAMPLE 4-2

The procedure for preparation of the toner layer regulating member No. 2-1 in Example 4-1 was repeated except that the cationic surface active agent contained in the composition for the overcoat layer used in Example 4-1 was replaced by a commercially available anionic surface active agent "EF 102" (Trademark), made by Mitsubishi Metal Corporation. Thus, toner layer regulating member No. 2—2 was prepared.

EXAMPLE 4-3

The procedure for preparation of the toner layer regulating member No. 2-1 in Example 4-1 was repeated except that the cationic surface active agent contained in the composition for the overcoat layer used in Example 4-1 was replaced by a commercially available ampholytic surface active agent "Ftergent 400S" (Trademark), made by Neos Co., Ltd. Thus, toner layer regulating member No. 2-3 was prepared.

EXAMPLE 4—4

Formation of First Overcoat Layer

A mixture of the following components was dip-coated on a copper plate and dried at 100° C. for one hour, so that a first overcoat layer with a thickness of 20 μm was formed.

| | Parts by Weight |
|---|---|
| Fluorine-containing copolymer resin "Lumifron 601C" (Trademark) made by Asahi Glass Co., Ltd. (solid content: 50%) | 100 |
| 50% xylene solution of "Coronate EH" made by Nippon Polyurethane Co., Ltd. | 20 |
| Fluorine-containing cationic surface active agent "EF 132" (Trademark) made by Mitsubishi Metal Corporation | 5 |
| Methyl ethyl ketone | 400 |

Formation of Second Overcoat Layer

A mixture of the following components was spray-coated on the above prepared first overcoat layer and dried at 100° C. for one hour, so that a second overcoat layer with a thickness of 20 μm was formed.

| | Parts by Weight |
|---|---|
| Fluorine-containing copolymer resin "Lumifron 601C" (Trademark) made by Asahi Glass Co., Ltd. (solid content: 50%) | 100 |
| 50% xylene solution of "Coronate EH" made by Nippon Polyurethane Co., Ltd. | 20 |
| Methyl ethyl ketone | 400 |

Thus, toner regulating member No. 2-4 with the configuration as shown in FIG. 13 was prepared.

EXAMPLE 4-5

The procedure for preparation of the toner regulating member No. 2-4 in Example 4—4 was repeated except that the cationic surface active agent contained in the composition for the first overcoat layer used in Example 4—4 was replaced by a commercially available anionic surface active agent "EF 102" (Trademark), made by Mitsubishi Metal Corporation. Thus, toner regulating member No. 2-5 was prepared.

EXAMPLE 4-6

The procedure for preparation of the toner regulating member No. 2-4 in Example 4—4 was repeated except that the cationic surface active agent contained in the composition for the first overcoat layer used in Example 4—4 was replaced by a commercially available ampholytic surface active agent "Ftergent 400S" (Trademark), made by Neos Co., Ltd. Thus, toner regulating member No. 2-3 was prepared.

COMPARATIVE EXAMPLE 4-1

The procedure for preparation of the toner layer regulating member No. 2-1 in Example 4-1 was repeated that the cationic surface active agent in the composition for the overcoat layer in Example 4-1 was not used. Thus, comparative toner layer regulating member No. 2-1 was prepared.

COMPARATIVE EXAMPLE 4-2

The procedure for preparation of the toner layer regulating member No. 2-1 in Example 4-1 was repeated except that the overcoat layer was not provided. Thus, comparative toner layer regulating member No. 2—2 was prepared.

Each of the above prepared toner layer regulating members No. 2-1 to No. 2-6 for use in the present invention and comparative toner layer regulating members No. 2-1 and 2-1 was set in the development unit as shown in FIG. 5. The charge quantity of the toner was measured in the same manner as in the above except that only negatively chargeable toner was used. In addition, the adhesion of toner particles to each toner layer regulating member was assessed in accordance with the above-mentioned rank, and the rising performance of the charge quantity of the toner was evaluated in the same manner as in the above. The results are shown in Table 5.

TABLE 5

| | Charge Quantity of Toner (μC/g) | | Adhesion of Toner to Toner Layer Regulating Member | Rising Performance of Charge Quantity of Toner (μC/g) | |
|---|---|---|---|---|---|
| | A** | B** | (Rank) | Q1 | Q2 |
| Ex. 4-1 | −11 | −10 | A | −10 | −11 |
| Ex. 4-2 | −10 | −10 | A | −9 | −10 |
| Ex. 4-3 | −12 | −11 | A | −11 | −12 |
| Ex. 4-4 | −12 | −11 | A | −11 | −12 |
| Ex. 4-2 | −11 | −11 | A | −10 | −11 |
| Ex. 4-3 | −13 | −12 | A | −12 | −13 |
| Comp. Ex. 4-1 | −13 | −5 | A | −4 | −13 |
| Comp. Ex. 4-2 | −8 | −4 | D | −8 | −8 |

**(A): The charge quantity of the toner in the initial stage.
(B): The charge quantity of the toner after 10,000 sheets were subjected to the copying operation.

As previously mentioned, in the development unit according to the present invention, at least the above-mentioned development member or the toner layer regulating member comprises an overcoat layer which comprises a resin and a surface active agent. Accordingly, the toner particles do not adhere to the surface of the development member or the toner layer regulating member, and the charge quantity of the toner can satisfactorily be maintained, so that high quality images are produced without formation of ghost toner images for an extended period of time.

What is claimed is:

1. In a development unit comprising (i) a latent-electrostatic-image-bearable member, (ii) a development member comprising an electroconductive substrate, for supporting a toner thereon and developing latent electrostatic images formed on said latent-electrostatic-image-bearable member into visible toner images with said toner, and (iii) a toner layer regulating member comprising an electroconductive substrate, for regulating the thickness of a toner layer formed on said development member, the improvement wherein at least said development member or said toner layer regulating member comprises an overcoat layer comprising a resin and a surface active agent formed on the electroconductive substrate of the development member or of the toner layer regulating member, said toner layer regulating member being grounded or comprising a charge injection means for injecting electric charges into said toner through said toner layer regulating member.

2. In a development unit comprising (i) a latent-electrostatic-image-bearable member, (ii) a development member for supporting a toner thereon and developing latent electrostatic images formed on said latent-electrostatic-image-bearable member into visible toner images with said toner, and (iii) a toner layer regulating member for regulating the thickness of a toner layer formed on said development member, the improvement wherein said development member comprises an overcoat layer comprising a resin and a surface active agent.

3. In a development unit comprising (i) a latent-electrostatic-image-bearable member, (ii) a development member for supporting a toner thereon and developing latent electrostatic images formed on said latent-electrostatic-image-bearable member into visible toner images with said toner, and (iii) a toner layer regulating member for regulating the thickness of a toner layer formed on said development member, the improvement wherein an overcoat layer comprising a resin and a surface active agent is formed on at least one of said development member and said toner layer regulating member, with the proviso that either said overcoat layer is formed at least on said development member or said regulating member comprises an electroconductive substrate and is grounded or provided with a charge injection means for injecting electric charges into said toner through said regulating member.

4. The development unit as claimed in claim 1, wherein said surface active agent is an ionic surface active agent.

5. The development unit as claimed in claim 1, wherein said surface active agent is an ampholytic surface active agent.

6. The development unit as claimed in claim 1, wherein said surface active agent is a nonionic surface active agent.

7. The development unit as claimed in claim 1, wherein said surface active agent is a fluorine-containing surface active agent.

8. The development unit as claimed in claim 7, wherein said fluorine-containing surface active agent is an ionic fluorine-containing surface active agent.

9. The development unit as claimed in claim 7, wherein said fluorine-containing surface active agent is an ampholytic fluorine-containing surface active agent.

10. The development unit as claimed in claim 7, wherein said fluorine-containing surface active agent is a nonionic fluorine-containing surface active agent.

11. The development unit as claimed in claim 8, wherein said ionic fluorine-containing surface active agent is a cationic surface active agent selected from the group consisting of perfluoroalkyl-containing quaternary ammonium salts.

12. The development unit as claimed in claim 8, wherein said ionic fluorine-containing surface active agent is an anionic surface active agent selected from the group consisting of monovalent metal salts of perfluoroalkyl-containing sulfonic acids and perfluoroalkyl-containing carboxylic acids and phosphoric esters.

13. The development unit as claimed in claim 9, wherein said ampholytic fluorine-containing surface active agent is selected from the group consisting of perfluoroalkyl-containing betaines.

14. The development unit as claimed in claim 10, wherein said nonionic fluorine-containing surface active agent is selected from the group consisting of perfluoroalkyl-group-hydrophilic-group-containing oligomers, perfluoroalkyl-group-lipophilic-group-containing oligomers and perfluoroalkylethylene oxide adducts.

15. The development unit as claimed in claim 1, wherein the amount of said surface active agent is in the range of 0.1 to 50 parts by weight of 100 parts by weight of the solid content of said resin.

16. The development unit as claimed in claim 2, wherein said development member comprises an electroconductive substrate and said overcoat layer formed thereon.

17. The development unit as claimed in claim 1, wherein said toner layer regulating member comprises an electroconductive substrate and said overcoat layer formed thereon.

18. The development unit as claimed in claim 16, wherein said electroconductive substrate is grounded.

19. The development unit as claimed in claim 17, wherein said electroconductive substrate is grounded.

20. The development unit as claimed in claim 17, further comprising a charge injection means for injecting electric charges into said toner through said toner layer regulating member.

21. The development unit as claimed in claim 20, wherein said charge injection means applies a bias voltage to said toner layer regulating member.

22. The development unit as claimed in claim 1, further comprising a toner replenishment roller which supplies said toner onto said development member.

23. The development unit as claimed in claim 22, wherein said toner replenishment roller is grounded.

24. The development unit as claimed in claim 16, wherein said overcoat layer of said development member consists of a first overcoat layer comprising said resin and said surface active agent and a second overcoat layer comprising a resin.

25. The development unit as claimed in claim 17, wherein said overcoat layer of said toner layer regulating member consists of a first overcoat layer comprising said resin and said surface active agent and a second overcoat layer comprising a resin.

* * * * *